United States Patent [19]

Koppes

[11] 4,364,699

[45] Dec. 21, 1982

[54] WHEELCHAIR TABLE AND FOOD TRAY FOR HANDICAPPED PERSONS

[76] Inventor: Cecilia R. Koppes, 417 C St., Washington, Kans. 66968

[21] Appl. No.: 176,053

[22] Filed: Aug. 7, 1980

[51] Int. Cl.[3] ..... A47G 21/00

[52] U.S. Cl. ..... 414/9; 206/563; 220/20; 220/23.8

[58] Field of Search ..... 414/9; 128/222; 206/557, 561, 563; 215/DIG. 5; 220/20, 23.8; D7/27, 38

[56] References Cited

U.S. PATENT DOCUMENTS

| | | | |
|---|---|---|---|
| 3,228,536 | 1/1966 | Gratzer | 414/9 |
| 3,317,061 | 5/1967 | Causey | 414/9 |
| 3,727,802 | 4/1973 | Schnurmacher | 128/222 X |
| 3,734,306 | 5/1973 | Morewood | 414/9 |

FOREIGN PATENT DOCUMENTS

| | | | |
|---|---|---|---|
| 400 | of 1909 | United Kingdom | 128/222 |

*Primary Examiner*—Leslie J. Paperner

*Attorney, Agent, or Firm*—Schmidt, Johnson, Hovey & Williams

[57] ABSTRACT

Equipment is provided for aiding persons in eating without substantial assistance when such persons are handicapped for some reason or cause which prevents them from using their arms and/or hands in the manipulation of utensils normally employed for eating purposes. Included therewithin is a tray provided with one or more mouthpieces into which food from the tray may be moved such that a mouthful of the food can be taken from the mouthpiece simply by the act on the part of the user of placing his mouth over the mouthpiece and the food thereon. Included also is a utensil mounted on a headpiece such that the user is able to manipulate selected quantities of food from the tray to the mouthpiece. Still further, the equipment includes a table for supporting the tray and adapted to be mounted on a wheelchair, the overall table assembly having an adequate number of adjusting features to permit proper positioning of the tray such that the user may easily carry out the self-feeding operation.

11 Claims, 11 Drawing Figures

FIG. 3
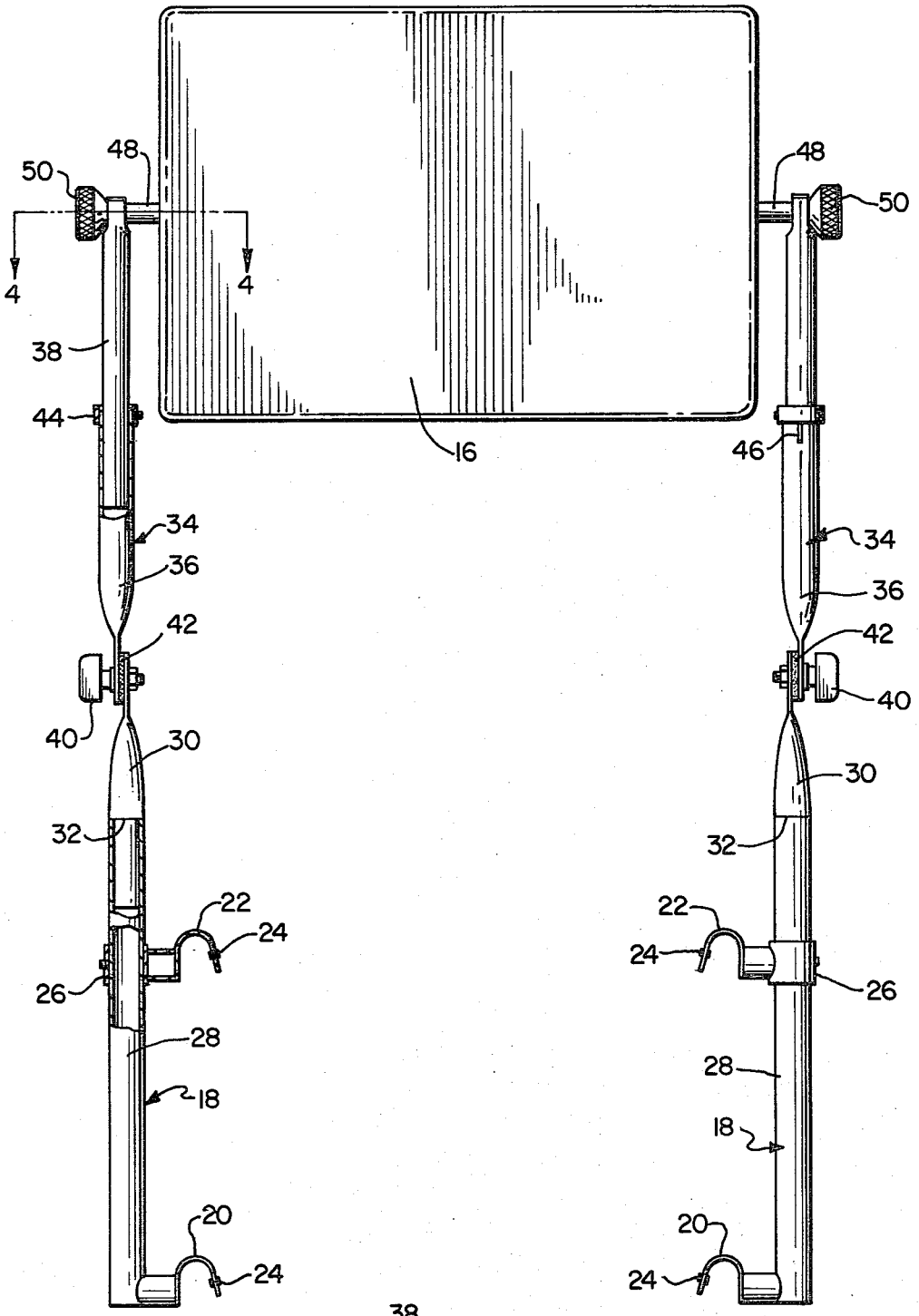
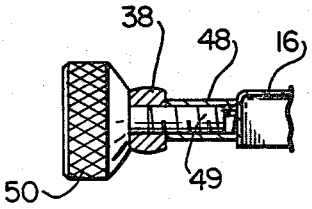
FIG. 4

FIG. 5
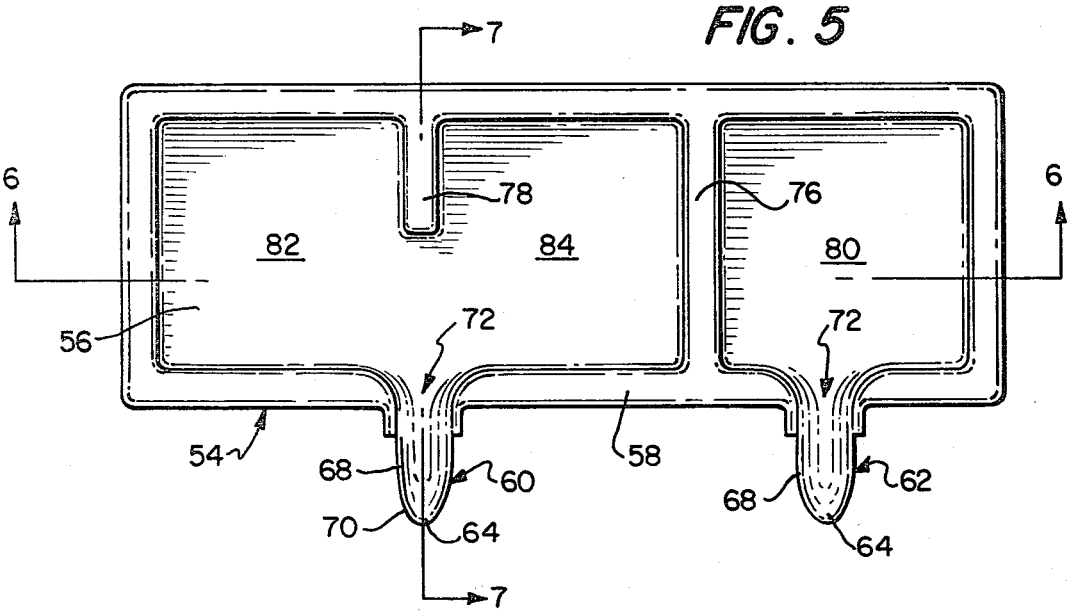
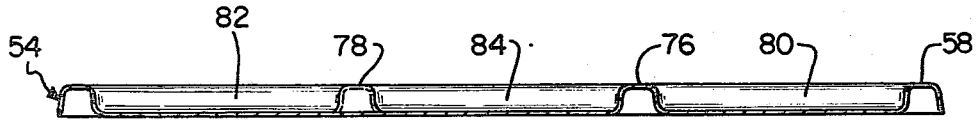
FIG. 6
FIG. 7
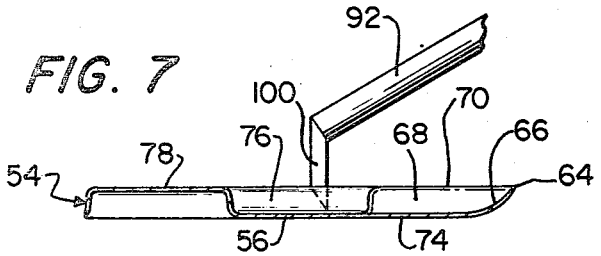
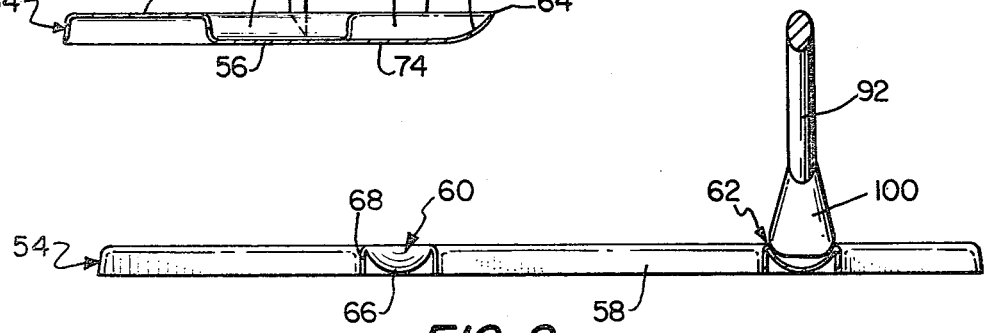
FIG. 8

WHEELCHAIR TABLE AND FOOD TRAY FOR HANDICAPPED PERSONS

It is well recognized that large numbers of individuals have handicaps of such nature that they are partially or totally unable to feed themselves in any normal manner as by using tableware to lift food from a plate, tray or the like and direct the food into their mouths. This condition, of course, is the result of paralysis or other condition affecting the use of the arms or the hands or both. Thus, under such circumstances, the handicapped person must, for the most part, be "spoon-fed" except possibly the ability to take in liquids through a straw.

In accordance with my present invention therefore, there is provided a special tray upon which the food is served to the handicapped person, whereupon he is able to move successive mouthfuls of food from the tray to any one of a number of mouthpieces extending laterally from one longitudinal edge of the tray. The open top mouthpiece with the food thereon is thereupon taken into the mouth such that through use of the upper lip, the food can be removed from the mouthpiece.

In conjunction with the aforementioned tray there is provided in accordance with the overall concepts of my invention, a headpiece worn by the user and provided with a utensil extending downwardly and forwardly from the forehead useable to select portions of food from the tray and withdraw the same toward the user and into the mouthpiece which communicates with the tray.

Still further, in those cases wherein the handicapped is able to use a wheelchair, I provide a tray supporting table detachably secured to the wheelchair and provided with arrangements which permit positioning of the tray strategically in front of the user, all because of multitudes of necessary or highly desirable adjustments between the tray itself and its main supporting components that are carried by the wheelchair. Additionally, while the table, in accordance with my present invention, can be quickly and easily removed from the wheelchair when not in use, I provide for nonuse storage of the tray in a suspended condition along one side of the wheelchair such that the table need not always be entirely removed when not actually in use.

In the drawings:

FIG. 3 is a view of the table shown in FIGS. 1 and 2 entirely removed from the wheelchair on an enlarged scale and illustrating its component parts extended therefrom with parts broken away and in section for clearness;

FIG. 4 is a fragmentary cross-sectional view still further enlarged taken on line 4—4 of FIG. 3;

FIG. 5 is a plan view of a food tray for handicapped persons made in accordance with my present invention;

FIG. 6 is a cross-sectional view taken on line 6—6 of FIG. 5;

FIG. 7 is a cross-sectional view taken on line 7—7 of FIG. 5 showing additionally a portion of a food manipulating implement for use by the handicapped person in conjunction with the tray;

FIG. 8 is an edge elevational view of the tray shown in FIGS. 5–7 together with a portion of the aforementioned implement;

Figure 1:
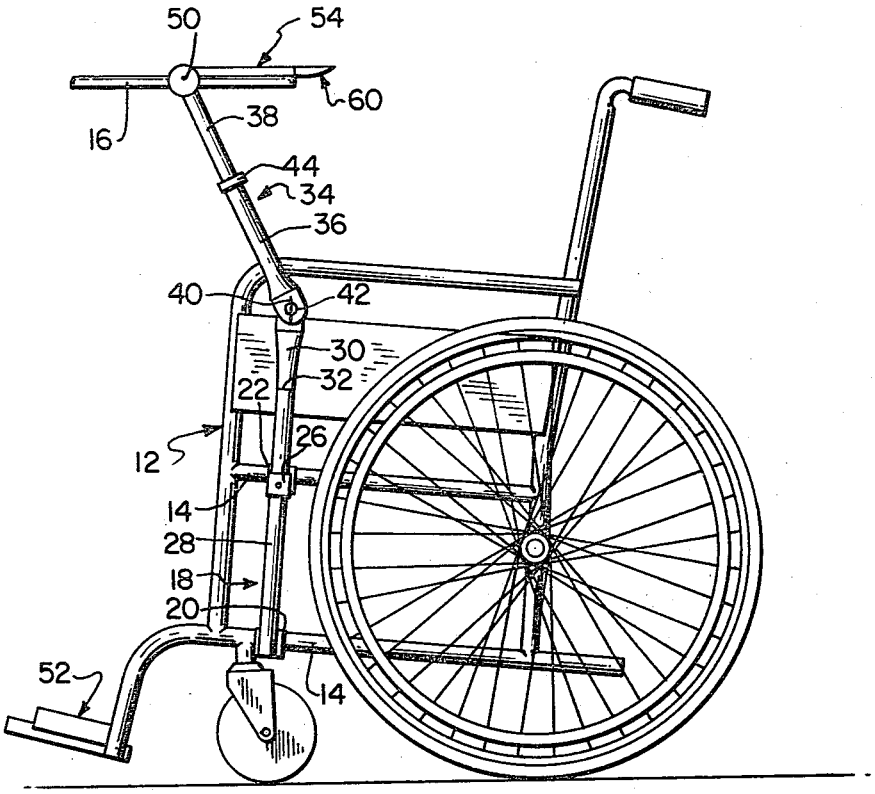
FIG. 1 is a side elevational view of a wheelchair having a table made in accordance with my present invention operably mounted thereon, together with a food tray coming within the scope of the instant invention shown supported on the table.
Figure 2:
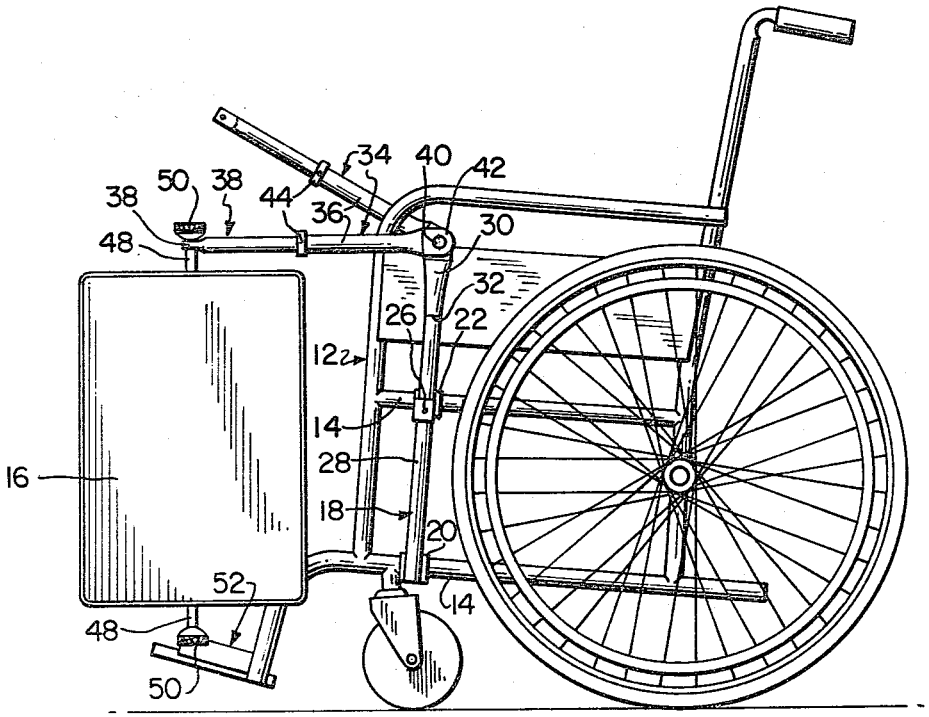
FIG. 2 is a view similar to FIG. 1 showing the table in a stored position suspended alongside the wheelchair adjacent its footrest.

A wheelchair 12, illustrated in FIGS. 1 and 2 of the drawings is provided with a pair of sides, only one of which is shown, each such sides having a pair of fore and aft frame members 14 adapted to support a tiltable table 16 of the kind that is also illustrated in FIGS. 3 and 4 of the drawings.

The table 16 is supported by the members 14—14 of the wheelchair 12 by a pair of legs 18 which, in turn, are provided with hooks 20 and 22 looped over the members 14 and releasably held in place by set screws 24. The upper hook 22 is adjustable along the tubular leg 18 by use of a set collar 26 so as to accommodate for differences in the spacings between the members 14 among various types of wheelchairs 12.

The leg 18 has a lower section 28 which receives an upper section 30, rotatable with respect to the section 28 and held against descent by a shoulder 32 on the section 30 engaging the upper end of the section 28.

Each leg has an arm 34 which, in turn, is provided with a pair of elements 36 and 38. The element 36 is releaseably attached to the upper section 30 of the leg 18 by a thumb bolt 40, the latter, when released, permitting swinging movement of the arm 34 about the essentially horizontal axis of the pivot bolt 40 and, after selected adjustment of the arm 34 and tightening of the bolt 40, a resilient washer 42 between the element 36 and the section 30 tends to hold the arm 34 in place.

The tubular element 36 receives the element 38 in that end of the former remote from the pivot bolt 40, and a set collar 44 is in fixed surrounding relationship to the element 36. The element 36 is split at several locations as at 46 such that upon tightening of the set collar 44, the element 36 is drawn tightly against the element 38.

The table 16 is provided with opposed, tubular, internally tapped studs 48, rigid thereto and extending outwardly from the ends of the table 16. The studs 48 releasably receive bolts 49 having knurled heads 50. As best seen in FIG. 4, the bolts 49 rotatably receive the terminable ends of the elements 38 and the heads 50 serve to releasably clamp the elements 38 against the proximal ends of the studs 48.

One operable position of the table 16 in front of the occupant of the wheelchair 12 is shown in FIG. 1 of the drawings wherein the legs 18, attached to the members 14 are essentially vertical, and wherein the arms 34 extend upwardly and forwardly from the upper ends of the legs 18, i.e. from the pivot bolts 40.

It is but necessary to release the bolts 40 slightly in order to swing the arms 34 downwardly and forwardly or upwardly and rearwardly, as desired. Moreover, in any of the numerous preselected positions of the arms 34, the table 16 may be adjusted from the level position shown in FIG. 1 to a tilted position, simply by releasing the grip of the heads 50 on the elements 38. Additionally, adjustment may be had by releasing the set collars 44 for the purpose of extension or retraction of the elements 38 with respect to the elements 36 of the arms 34.

It is to be noted that the table 16 is in the nature of a shallow pan, having a continuous flange therearound. Therefore, upon release of the bolts 49, rendering the table 16 rotatable 360°, the table 16 may be reversed from the position shown in FIGS. 1 and 9. In that position, the table 16 is better adapted to maintain articles thereon than on the flat surface shown in FIG. 3.

At any time one may desire, the entire table assembly may be removed from the wheelchair 12 by merely loosening the set screws 24 such as to permit removal of the legs 18 from the members 14. On the other hand, during non-use of the table 16, it may be placed in the position illustrated by FIG. 2 of the drawings. This is accomplished by removal of one of the bolts 49 to permit complete detachment from the corresponding element 38. The table 16 may be moved to a position suspended from the other of the elements 38 as shown in FIG. 2 by loosening of the corresponding bolt 40 such as to swing one of the arms 34 to the horizontal position shown in FIG. 2. In that condition, the table 16 is disposed adjacent footrest 52 of the wheelchair 12. However, the table 16 may be moved from the position shown in FIG. 2, to a position disposed rearwardly of the proximal leg 18 because of the rotatable connection, aforementioned, between the sections 28 and 30 of the leg 18. Still further, and in addition to all of the foregoing, the table 16 may be placed in storage, if desired, by simply lifting the sections 30 out of the sections 28 of the legs 18.

As shown in FIG. 1, the table 16 is especially adapted to support a food tray 54 of the kind best shown in FIGS. 5–8 of the drawings. The tray 54 has a preferably flat, smooth upper surface 56, essentially surrounded by an upstanding flange 58, interrupted only at one longitudinal edge of the elongated tray 54 by a pair of mouthpieces 60 and 62 communicating with the upper surface 56. The mouthpieces 60 and 62 may be identical; hence, only one will be described.

Mouthpiece 60 is essentially semi-ovoidal, open at its top and provide with an outermost terminal end 64 which has an inner arcuate configuration 66 as best shown in FIG. 7. Therefore, as in the case of the tray 54 itself, each of the mouthpieces 60 and 62 has an upturned longitudinally extending flange 68, terminating in an essentially U-shaped upper edge 70 whose bight is adjacent the end 64. Presented, therefore, is an entrance 72 from the surface 56 to the uppermost, elongated, straight bottom surface 74 of the mouthpiece 60 coplanar with the surface 56. Noteworthy also is the fact that the entire mouthpiece 60 has a smooth convex lowermost face, adapting the mouthpiece 60 for reception within the mouth of the user for purposes about to be described.

Food may be placed on the surface 56 of the tray 54 by an attendant and, desirably, such food is separated by upstanding partitions 76 and 78 on the surface 56. This presents a compartment 80 communicating with the mouthpiece 62 and a pair of compartments 82 and 84, both of which communicate by way of the entrance 72 with the mouthpiece 60.

Under certain conditions, depending upon the exact nature of the disability of the user, he may well be able to utilize eating utensils, such as spoons and forks, at least to the extent of pulling portions of the food from the compartments 80, 82 and 84 into the mouthpieces 60 and 62 even though the user is unable to actually lift portions of the food from the tray 54 on the table 16 into his mouth.

In that event, after a mouthful of food is manipulated into the mouthpiece 60, for example, the user seated within the wheelchair 12 moves his head downwardly and forwardly to a position wherein he can take the mouthpiece 60 and the food portion thereon into his mouth. At that juncture, by holding his lips tightly over the food and beneath the lower face of the mouthpiece 60, he can withdraw the food from the mouthpiece 60 into his mouth for normal mastication. Noteworthy at this juncture is the fact that the mouthpieces 60 and 62 are purposely shaped and sized as is evident from FIGS. 5–8 to permit the foregoing eating steps with ease and without danger of mouth irritation.

Figure 9:
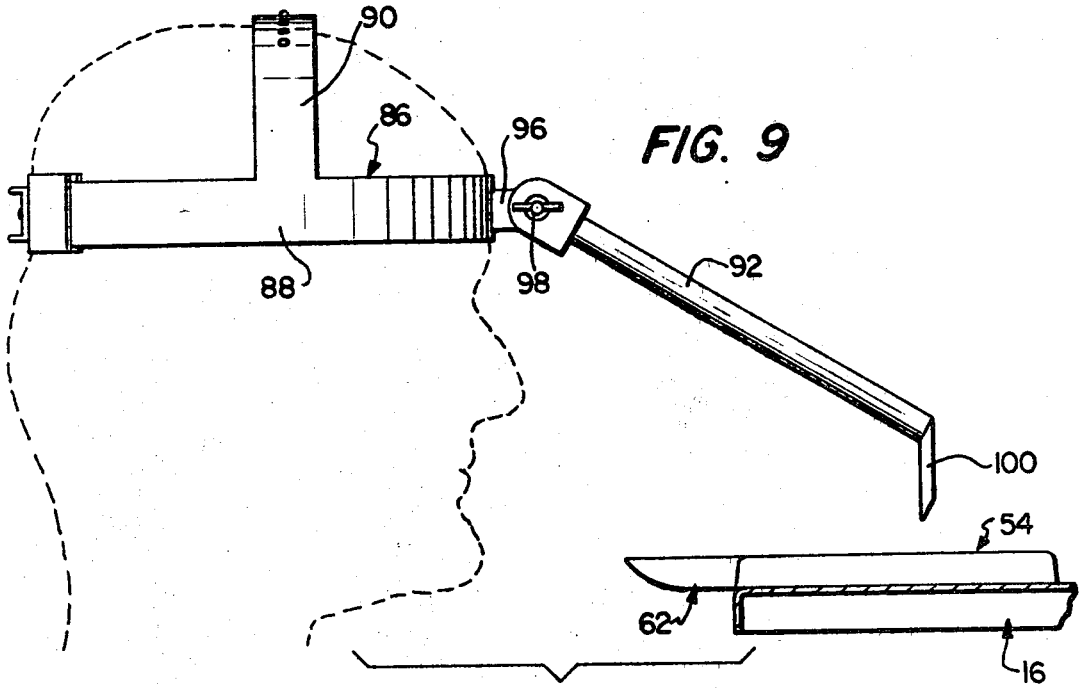
FIG. 9 is an end elevational view of the food tray shown in FIGS. 1 and 5–8, illustrating additionally the mounting of the food handling implement on a headpiece being worn by the user.
Figure 10:
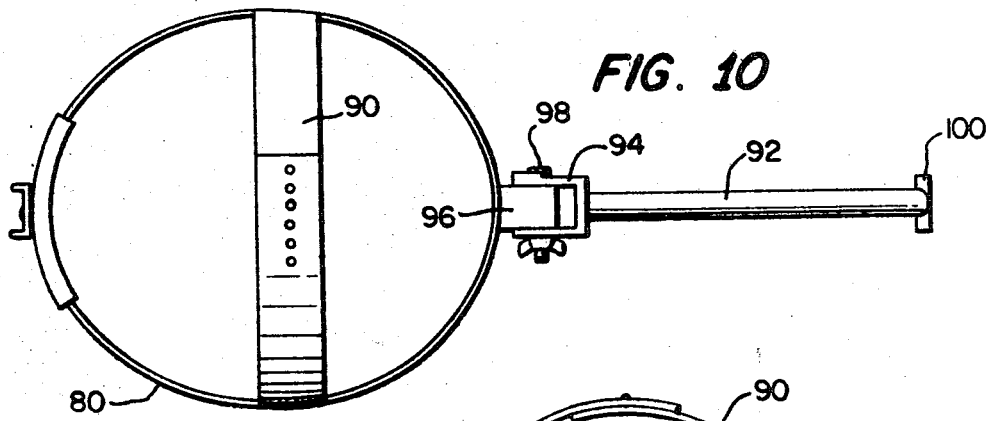
FIG. 10 is a plan view of the headpiece and implement entirely removed from the head of the user.
Figure 11:
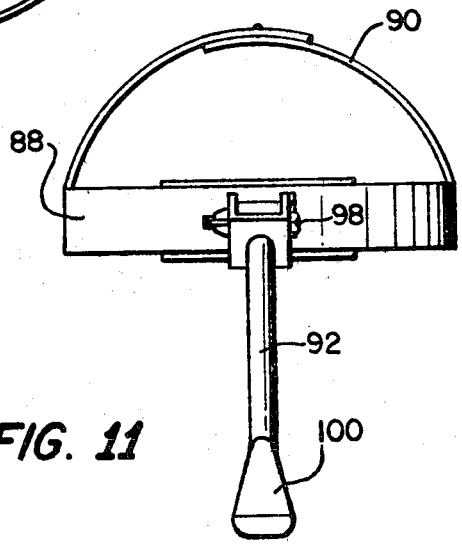
FIG. 11 is a front elevational view of the headpiece-implement assembly illustrated by FIGS. 9 and 10.

Equally important is to adapt the equipment of my invention for use by handicapped persons who may be totally unable to use their upper limbs for eating purposes; therefore, there is shown in FIGS. 9–11 of the drawings accessories for use in connection with the tray 54, whether used on the table 16 or placed upon other convenient tables or the like.

A headpiece 86 has an adjustable strap 88, together with an over-the-head adjustable strap 90. The strap 88 carries a shank 92 provided with a bifurcated end 94 which receives an extension 96 on the strap 88 adjacent the user's forehead, and a releasable pivot bolt 98 interconnects the shank 92 and the extension 96.

The outermost and lowermost end of the shank 92 remote from the pivot bolt 98 has a food-handling implement 100 thereon which may, in a sense, be spadelike and, therefore, adapted to not only separate the food on the tray 54 into discreet portions, but usable in pulling the food from the surface 56 into either of the entrances 72 by proper manipulation of the head of the user. To this end, the implement portion 100 is offset downwardly from the shank 92 and its relationship to the tray 54 as well as to the mouthpiece 62 is shown in FIGS. 7 and 8 respectively.

It has been found, through actual use of the equipment above described by a handicapped person totally unable to manipulate arms and hands for feeding purposes, that the requirements of use are so simple and so easily learned that much assistance is entirely eliminated after the food is placed on the tray 54 and the headpiece 86 is mounted in place. At that juncture, the benefits do not flow solely to attendants; on the contrary, it has been found that substantial gratification is experienced by the handicapped in being able to carry on with these independent functions leisurely and confidently.

In the event there is a need to prevent displacement of the tray 54 during use on the table 16, magnets may be mounted on the tray 54 and the table 16 and, if metal is used to make either or both of such parts, but one set of magnets will be needed.

I claim:

1. A device for aiding a handicapped person in eating comprising:

a relatively shallow, flat, rectangular food tray; and an elongated, open top, relatively narrow mouthpiece integral with the tray and extending outwardly from one longitudinal edge of the tray intermediate and spaced from both ends of the tray, said mouthpiece communicating with the tray for reception of food moved into the mouthpiece from the tray, said mouthpiece and the food thereon being adapted for reception into the mouth of said person for removal of the food by said person from the mouthpiece, said tray being, except for said mouthpiece, closed along its entire periphery by integral, continuous, upstanding, low profile, food retention means of uniform height.

2. The invention of claim 1, said tray and mouthpiece having essentially coplanar, smooth, uppermost, food-receiving surfaces.

3. The invention of claim 2, said tray and mouthpiece having food-retaining flanges extending upwardly from said surfaces thereof.

4. The invention of claim 3, said mouthpiece being elongated, terminating in an end remote from the tray and provided with an entrance opposite to said end for moving food thereinto from the tray.

5. The invention of claim 4, said mouthpiece having its longitudinal axis extending from said end to said entrance.

6. The invention of claim 5, said surface of the mouthpiece spanning the distance between the flanges thereof, being transversely concave and being longitudinally straight.

7. The invention of claim 6, said end of the mouthpiece having an arcuate uppermost and innermost face.

8. The invention of claim 7, said mouthpiece and its end thereof having convex lowermost surfaces.

9. The invention of claim 8, said tray having raised food-separating partition means on said surface thereof.

10. The invention of claim 9, said tray having a longitudinal axis perpendicular to said axis of the mouthpiece.

11. The invention of claim 10, said mouthpiece being provided with an essentially U-shaped, uppermost edge extending between said end and said entrance with the bight of the edge extending along said end.

* * * * *